US006155418A

United States Patent [19]

Chang

[11] Patent Number: 6,155,418

[45] Date of Patent: Dec. 5, 2000

[54] GOLF BAG FOR SECURING GOLF CLUBS

[76] Inventor: Saeho Chang, 927 New Norwalk Rd., New Canaan, Conn. 06840

[21] Appl. No.: 09/173,546

[22] Filed: Oct. 16, 1998

[30] Foreign Application Priority Data

Jul. 25, 1998 [KR] Rep. of Korea ..... 98-30033

[51] Int. Cl.[7] ..... A63B 65/00

[52] U.S. Cl. ..... 206/315.6

[58] Field of Search ..... 206/315.3, 315.5, 206/315.6, 315.8

[56] References Cited

U.S. PATENT DOCUMENTS

| | | | |
|---|---|---|---|
| 1,092,729 | 4/1914 | Kirby | 206/315.6 X |
| 1,876,134 | 9/1932 | Clawson | 206/315.6 |
| 2,685,317 | 8/1954 | Lace et al. | 206/315.6 |
| 2,752,973 | 7/1956 | Stamp | 206/315.6 |
| 2,879,819 | 3/1959 | Turnbull | 206/315.6 X |
| 4,055,207 | 10/1977 | Goodwin | 206/315.6 |
| 4,208,227 | 6/1980 | Cowan | 206/315.6 X |
| 5,071,147 | 12/1991 | Stansbyry | 206/315.6 |
| 5,228,566 | 7/1993 | Shenoha | 206/315.6 |
| 5,450,958 | 9/1995 | Shin | 206/315.6 |
| 5,842,565 | 12/1998 | Hagaman | 206/315.6 |

*Primary Examiner*—Stephen P. Garbe
*Assistant Examiner*—Tri M. Mai
*Attorney, Agent, or Firm*—Jacobson, Price, Holman & Stern, PLLC

[57] ABSTRACT

A golf bag for securing golf clubs including at least one deck formed at the top end of the bag, the deck having a height so that grips of the golf clubs being inserted into the bag do not touch a bottom of the golf bag, top front edges of the deck for laying club heads evenly across the deck, and a wedge-shaped material member attached to an interior wall of individual vertical club compartment for pushing club grips and shafts lightly toward one side of the compartment as one inserts golf clubs into the vertical compartment.

16 Claims, 3 Drawing Sheets

GOLF BAG FOR SECURING GOLF CLUBS

BACKGROUND OF THE INVENTION

1. Field of the Invention

The present invention relates to a golf bag for securing golf clubs which are inserted into the bag. More particularly, the present invention relates to a golf bag which has enough height so that the grips of the clubs do not touch the bottom of the golf bag so that the clubs hang freely from the top, thus eliminating unnecessary stress on the club shafts. The present invention further relates to a golf bag which has a wedge-shaped piece of material fixed to the interior wall of vertical compartment which provides soft hug as one inserts golf clubs into the compartment such that the clubs stay in one position without being shaken all over the place inside the bag, thus providing a complete protection of the club shafts while eliminating noise due to collision among golf clubs.

2. Description of the Related Art

Typical golf bags sold in the marketplace today have a shape of a cylinder with a single tier design at the top with a very slight angle. The height of these bags are about the length of a sand wedge and the head portion of golf clubs of various lengths stick out of the bag when they are placed in the bag. During transport by a person or golf cart, the clubs move back and forth due to rocking and shaking motions of the bag. Consequently, the clubs tend to hit each other when the bags are transported by a person or golf cart, causing the heads of the similar-sized clubs to strike each other. In addition, the shafts of the longer clubs, such as the driver and the woods, are continually struck by the heads of shorter irons and/or putter. Thus, not only the heads of all clubs are subject to damage, but particularly the shafts of taller clubs, which are typically made of graphite materials, are often damaged.

Golf club head covers are sometimes used for driver and woods with longer shafts, however, the impact of the hits among the golf clubs is often strong enough to go right through these covers and cause damage to the graphite shafts of these very expensive clubs. Frequently, the shaft and neck of very expensive driver or woods are broken as golf bags accidentally fall down to the side. Thus club protections provided by head covers are insufficient.

Many top end of traditional golf bags are divided into several sections to allow clubs to be inserted in a sorted manner. Some dividers are designed to extend all the way down to the bottom of the bag. However, it is impossible to protect club shafts from being hit by other shorter clubs that are inserted right next to them within the same section or the shorter clubs that are put into one of the neighboring sections. Some bags today have a non-circular shape and a top end designed with many sections with slightly different heights that are somewhat apart from one another to keep the clubs away from each other as much as possible. But, again it is impossible to fully protect the clubs from each other because the physical separation of these sections are not sufficient and the top portions of the club shafts are still exposed well above the top of these golf bags.

Some bags are made with individual vertical tubes or compartments for each of the clubs. These bags provide better organization and easier club access in and out of the bag. However, the distance among the club holes are too small, and again good portions of the club shafts of the longer clubs do stick out of the bag, thus being exposed for potential physical damage.

The clubs make undesired excessive noises when golf bags are transported by golf cart, thus bothering other players when they are trying to concentrate to hit their balls. In addition, the club vibrations while being transported by a golf cart are very severe and shorten the life of clubs. The shaft is damaged by not only by the one-sided, uneven distribution of head weight which causes a slight bend over time, but also from literally non-countable, visible and non-visible vibrations when the bags are shaken by a moving golf cart.

Clubs are typically inserted into the bag in a disorderly manner and it is difficult to find the needed clubs without often going through many clubs. Likewise, putting the clubs back into the same spot of golf bag is often a challenge. These problems waste golfers' time and unnecessary energy and attention away from the game. Also, when clubs are missing from golf bag, it is not easy to identify the missing clubs in today's bags since it is difficult to insert golf clubs in any organized fashion and the inserted golf clubs are often tangled up with each other.

Although golf bags come with a golf bag cover, the clubs move around freely within the golf bag during transportation, especially during traveling, thus causing damage to golf clubs. Club shafts, especially those of driver and woods that stick out of a golf bag the most, often break during transportation especially if the bag is handled improperly in cargo areas or is hit by other heavy luggage. Some people pack the bag with towels around the necks of long driver and woods to give an extra protection when they ship the golf bag through an airport.

People spend lots of money to protect their golf clubs and yet accomplish very little. They buy club head covers for woods and irons. They buy separate traveling golf bag covers into which the entire golf bag is inserted. Yet the clubs still move around inside the space within the golf bag cover which comes with the bag.

Traditional golf bags filled with clubs are often unbalanced due to the fact that clubs are often inserted in a disorderly manner causing uneven weight distribution. This causes the bag to fall and increase the possibility of damaging the club shafts.

The top section of some of the golf bags are designed with little tiny holes, sometime with soft rubber material, to accommodate individual clubs. Although the movements of club shafts are reduced significantly when individual holes are made reasonably small, it is very difficult to put the clubs back into those small holes during the playing time. It is time-consuming and the players are often pressured with other things related to the game. More importantly, those tiny holes do not really protect club shafts; in fact, they make a ring around the graphite club shafts after some use. Also, the distances among those holes are too small to prevent the club heads from hitting the shafts of other nearby clubs.

SUMMARY OF THE INVENTION

The present invention is directed to a golf bag that substantially obviates one or more problems due to limitations and disadvantages of the related art.

A primary object of the present invention is to provide a golf bag which fully protects club shafts from forces outside the bag or club heads of other clubs within the same bag.

Another object of the present invention is to provide a golf bag which fully protects club shafts from the vibrations coming from vigorous club movements when the grips touch the bottom of the moving golf bag.

Another object of the present invention is to provide a golf bag which prevents club shaft from being bent or uneven wear and tear of textures of graphite material coming from one-sided unevenly distributed club head weight.

Another object of the present invention is to provide a golf bag which facilitates prolonging the life of golf clubs by allowing them to rest freely in the air due to club elevation during non-playing time.

Another object of the present invention is to provide a golf bag which prevents wear and tear on club grips due to being bounced around inside the bag.

Another object of the present invention is to provide a golf bag which facilitates time saving due to: elimination of the need for taking off and putting on club head covers during the game; and minimizing the time wasted to look for the right clubs during the game.

Another object of the present invention is to provide a golf bag which facilitates lowering the probability of losing golf clubs out in the field by enabling quick identification of a club loss through a quick visual check of missing clubs.

Another object of the present invention is to provide a golf bag which eliminates or minimizes undesired, disturbing, and distracting noises that are caused by the clubs, hitting rapidly one another especially when they are carried on a cart during the game.

Another object of the present invention is to provide a golf bag which facilitates cost savings due to elimination of the need to purchase expensive golf club head covers, iron head covers, individual tubes designed to protect a single club, and traveling bags.

Another object of the present invention is to provide a golf bag which provides much more even balance of the bag to facilitate carrying the bag.

Another object of the present invention is to provide a golf bag which facilitates prevention of unexpected falls of bag caused by uneven weight distribution and imbalance caused by disorderly inserted clubs in traditional bags.

To achieve these objects and provide other advantages, and in accordance with the purpose of the invention as embodied and broadly described, the invention provides a golf bag for securing golf clubs including at least one deck formed at the top end of the bag, the decks are tall enough so that grips of the golf clubs being inserted into their respective individual vertical club compartments of the bag do not touch a bottom of the golf bag, top front edges of the decks for laying club heads evenly across the decks, and a wedge-shaped piece of soft material attached to an interior wall of individual vertical club compartment for pushing club grips and shafts toward the front or back side of the compartment as one inserts golf clubs into the vertical compartment.

DETAILED DESCRIPTION OF THE PREFERRED EMBODIMENT

Figure 1:
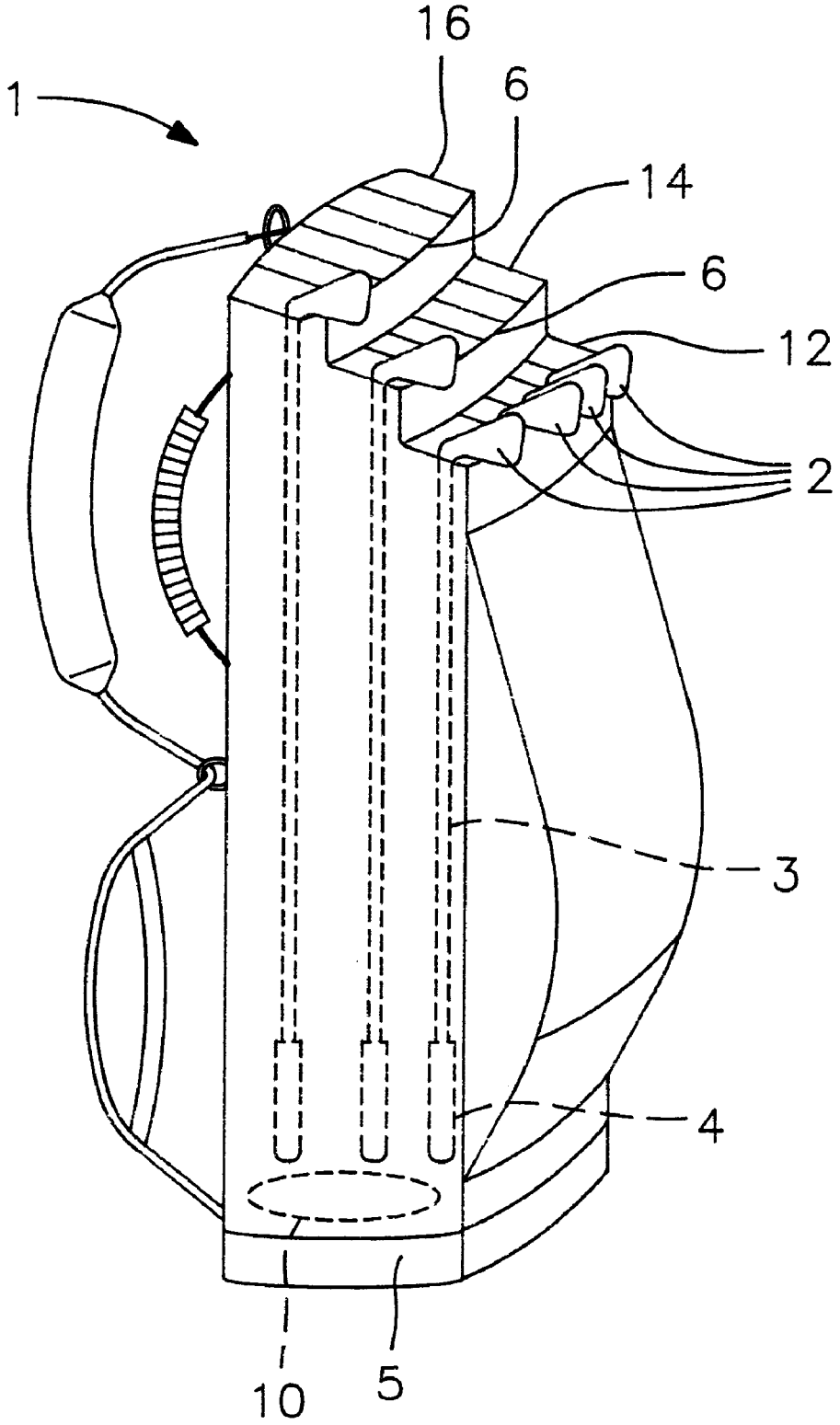
FIG. 1 is a perspective view of the golf bag according to a preferred embodiment of the present invention.

FIG. 1 shows a golf bag 1 having multiple decks 12, 14 and 16. As shown in FIG. 1, the heights of the decks are designed to be sufficiently tall so that the grips 4 of the clubs that are inserted into the vertical club compartments never touch the bottom 5 of the golf bag 1 (see the space 10). Thus, the clubs hang freely from the top of the bag, resting in the air due to club elevation.

Such multiple decks are further described in copending application Ser. No. 09/173,545 entitled "GOLF BAG HAVING MULTIPLE DECKS FOR ISOLATING CLUBS" and other club securing device is further described in copending application Ser. No. 09/173,544 entitled "GOLF CLUB SECURING AND PROTECTION DEVICE FOR A GOLF BAG", each to Chang and filed concurrently herewith, each of which are incorporated herein by reference.

All club heads 2 lie evenly across each deck since all clubs are fully inserted into the club compartments. This creates a natural and even protection of the club shafts 3 since they are completely hidden inside the individual compartments, thus not allowing anything to hit the club shafts 3 from outside the bag 1, including the heads of other clubs within the same bag 1.

The club shafts 3 inserted in this golf bag 1 have little to no tension whatsoever because they do not have to support the weight of the club heads 2, which is heavy and one-sided, and they are not bounced around on the rocking floor and shaken severely with damaging vibrations.

The bag is designed so that the club heads 2 rest on the top front edges 6 of the club compartments when the clubs are inserted into the bag. In addition, due to the different elevations of the decks, 12, 14, 16, the heads of one deck do not interfere with, or strike, the clubs at a different deck.

The widths of club compartments, or the widths of decks, are made shorter than the lengths of club heads so that the club heads 2 can not fall through vertical club compartments.

Figure 2:
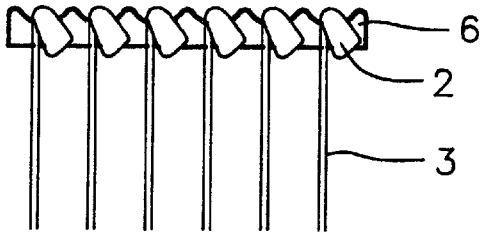
FIG. 2. is a top front view of the golf bag according to the preferred embodiment of the present invention.
Figure 3A:
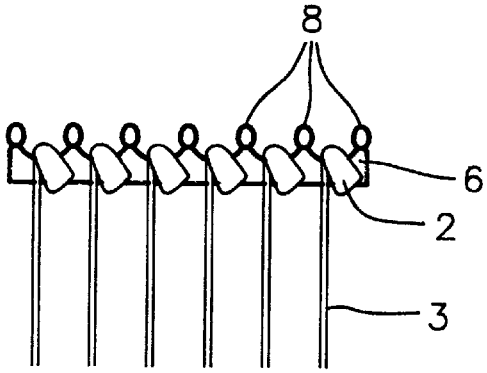
FIG. 3A is a top front view of the golf bag according to a second embodiment of the present invention.
Figure 3B:
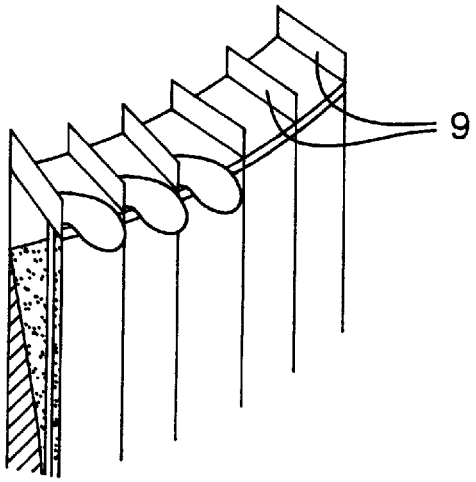
FIG. 3B is a view illustrating the protruded dividers according to the second embodiment of the present invention.

Top front edges of the decks 6, or front edges of the individual club compartments, are made with a soft material with some built-in frictions (e.g. elastic sponge, soft sticky rubber, special cloth padded with sponge, etc.). The edging material is designed to be pressed down slightly to form a trench or channel having concave curved shape. The channel of each club compartment holds the head 2 of the respective club in place as shown in FIG. 2, thus minimizing sliding and rotational movements. The degree of which the top front edges of the decks 6 are pressed down depends on two factors: the natural weight of the golf club and golf club heads 2 and the power which is applied to the motion of inserting the golf club when a person puts a club into the bag At the top front corners of the vertical club compartments, both left and right (and/or along the top edges of vertical sections in between individual club compartments), specially designed pieces of material (e.g. rubber, plastic, metal, and others) can be attached as illustrated in FIGS. 3A and 3B. This special pieces of material, protruded dividers 8 or protruded dividing member 9, prevent side ways and rotational movements of the club head in one club compartment into the spaces above its neighboring club compartments.

Figure 4:
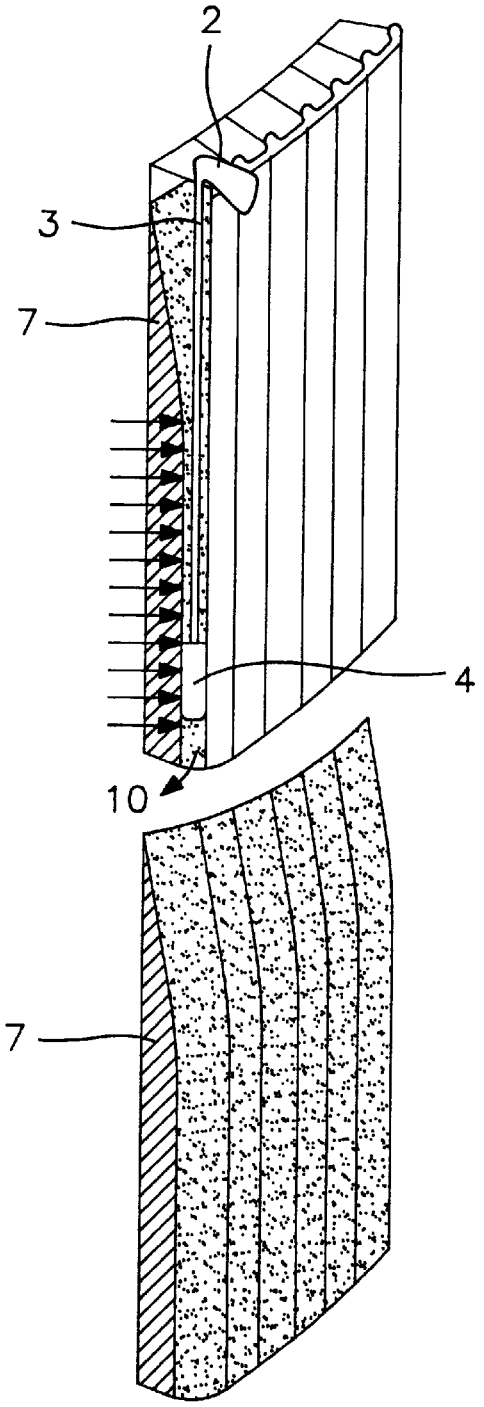
FIG. 4 is a view illustrating the wedge-shaped piece of material according to the preferred embodiment of the present invention.

FIG. 4 illustrates club hugging feature according to the preferred embodiment of the present invention. As shown in FIG. 4, a wedge-shaped piece of material 7 pushes the club grips 4 and shafts 3 lightly toward the opposite side, thus creating an effect of a soft hug as one inserts golf clubs into the vertical club compartment. This soft hug enables the club to stay in one position without being shaken all over the place inside the bag.

Figure 5:
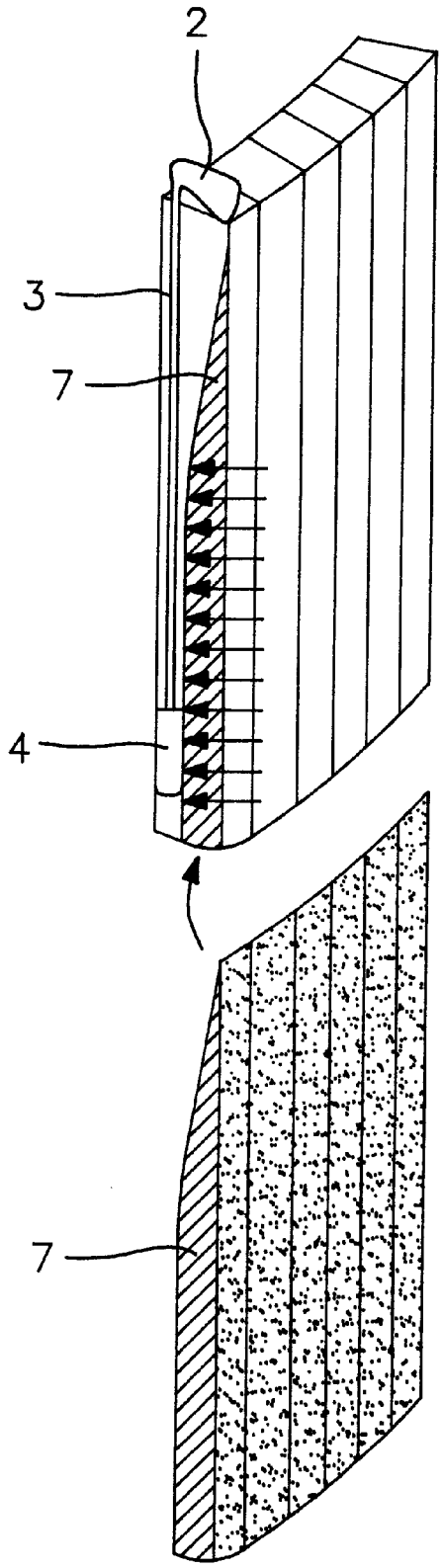
FIG. 5 is a view illustrating the wedge-shaped piece of material according to the second embodiment of the present invention.

In addition, through its gentle pushing mechanism toward the opposite side within the compartment, the club grips 4 and shafts 3 are naturally pushed to one side, moving the club heads 2 to rest on the top front edges of the decks 6, evenly across the deck. This wedge-shaped piece of material can be attached to the rear wall of the club compartment as shown in FIG. 4 or to the front wall of the club compartment as shown in FIG. 5 depending on the design of golf bag. In addition to the feature of freely hanging the clubs as shown in FIG. 1, the wedge-shaped piece of material 7 further minimizes unnecessary movements of the club shafts within the bag. The wedge-shaped piece of material 7 could be an insert that fits most types of golf bags, including the traditional golf bags without the multiple deck structure. The wedge-shaped material 7 can be also applied to golf bags that have multiple decks without employing the feature of freely hanging the clubs as shown in FIG. 1.

As shown in FIG. 4, the wedge-shaped piece of material 7 is attached to the interior wall of individual vertical club compartments. The material is preferably soft and has a bouncing back motion when it is pressed in, like a sponge, so as to exert a force against the club and hold the club in place. The force exerted by material 7 also reduces rotational movement of the clubs. The exterior of this wedge-shaped piece of material 7 should be made slippery so that a club may be easily pushed in and removed from the club compartment. This can be accomplished, for instance, by wrapping the wedge-shaped piece of material 7 with nylon or a similar material.

The top opening of the individual club compartment does not enable the wedge-shaped piece of material 7 to be seen inside the compartment. This provides a wide opening at the top to enable easy access, in and out of the vertical compartments with golf clubs. The wedge-shaped piece of material 7 is made gradually thinner at the top section of the club compartments to better receive and guide the club toward the one side of the compartment.

The wedge-shaped piece of material 7 can be attached individually inside each of the club compartments, or attached in an integrated fashion across multiple club compartments by design.

The amount of vertical gap between the wedge-shaped piece of material 7 and the opposite side interior wall of club compartment should be made in such a way that one really feels as if someone is hugging the club grips 4 and the shafts 3 as one places the clubs into the bag 1. The tension or friction should not be too much or too little. The tension should be sufficient enough to make the person really feel that the clubs are in good hands and well protected without any outside forces, but still allow easily insertion and removal of the clubs.

It will be apparent to those skilled in the art that various modifications can be made in the golf bag without departing from the spirit or scope of the invention. Thus, it is intended that the present invention covers modifications and variations of the invention within the scope of the appended claims and their equivalents.

What I claim is:

1. A golf bag for securing golf clubs, comprising:

at least one deck formed at a top end of the bag, said at least one deck having individual vertical club compartments for receiving the golf clubs, said deck having a height so that grips of the golf clubs being inserted into the individual vertical club compartments do not touch a bottom of the golf bag;

a club placement member formed at top front edges of the deck and the individual vertical club compartments for laying club heads evenly across said at least one deck and a wedge-shaped material member secured within at least one individual vertical club compartment for pushing a club grip toward one side of the vertical club compartment as a golf club is inserted into the vertical club compartment.

2. The golf bag according to claim 1, wherein width of the individual club compartments are shorter than the lengths of the club heads.

3. The golf bag according to claim 1, wherein the club placement member is made of a soft durable material.

4. The golf bag according to claim 1, further comprising protruded dividers formed at the top front corners of the individual club compartments for preventing side and rotational movements of the club heads.

5. The golf bag according to claim 3, wherein the soft durable material is selected from the group consisting of elastic sponge, soft sticky rubber, cloth padded with sponge and cushioned fabric.

6. The golf bag according to claim 5, wherein said protruded dividers are made of a material selected from the group consisting of rubber, plastic, metal and fabric.

7. The golf bag according to claim 1, further comprising protruded dividing members formed along the top edges of vertical sections in between individual club compartments.

8. The golf bag according to claim 1, wherein said material member is made of soft sponge which has a bouncing back motion.

9. The golf bag according to claim 1, wherein an exterior of said material member is slippery when a club is pushed in and out of the bag.

10. The golf bag according to claim 1, wherein the wedge-shaped material member is made gradually thinner toward a top section of the vertical compartment.

11. A golf bag for securing golf clubs, comprising:

at least one deck formed at a top end of the bag said at least one deck having individual vertical club compartments for receiving the golf clubs;

a wedge-shaped material member formed within at least one vertical club compartment for pushing a club grip and at least a portion of a shaft toward one side of the individual vertical compartment of a golf club that is fully inserted into the individual vertical club compartment; and protruded dividing members formed along the top edges of vertical sections in between the vertical club compartments.

12. The golf bag according to claim 11, further comprising protruded dividers formed on the top front edges of the decks for preventing side and rotational movements of the club heads.

13. The golf bag according to claim 12, wherein said protruded dividers are made of a material selected from the group consisting of rubber, plastic, metal and fabric.

14. The golf bag according to claim 11, wherein said material member is made of soft sponge which has a bouncing back motion.

15. The golf bag according to claim 11, wherein an exterior of said material member is slippery so that there is a reduced friction when a club is pushed in and out of the bag.

16. The golf bag according to claim 11, wherein the material member is made gradually thinner toward a top section of the vertical compartment.

* * * * *